US007273024B2

(12) United States Patent
Lancefield et al.

(10) Patent No.: US 7,273,024 B2
(45) Date of Patent: Sep. 25, 2007

(54) ENGINE WITH VARIABLE VALVE TIMING

(75) Inventors: Timothy Mark Lancefield, Warwickshire (GB); Richard Alwyn Owen, Oxfordshire (GB); Ian Methley, Witney (GB); Nicholas Lawrence, Buckingham (GB)

(73) Assignee: Mechadyne PLC, Kirtlington, Oxford (GB)

( * ) Notice: Subject to any disclaimer, the term of this patent is extended or adjusted under 35 U.S.C. 154(b) by 268 days.

(21) Appl. No.: 11/157,748

(22) Filed: Jun. 20, 2005

(65) Prior Publication Data

US 2005/0279302 A1 Dec. 22, 2005

(30) Foreign Application Priority Data

Jun. 21, 2004 (GB) ..... 0413887.1

(51) Int. Cl.
*F01L 1/34* (2006.01)

(52) U.S. Cl. ..... 123/90.15; 123/90.17; 123/90.31

(58) Field of Classification Search ..... 123/90.15, 123/90.16, 90.17, 90.18, 90.27, 90.31, 90.6; 29/888.1
See application file for complete search history.

(56) References Cited

U.S. PATENT DOCUMENTS 6,953,015 B2 * 10/2005 Asari et al. ..... 123/90.27

* cited by examiner

*Primary Examiner*—Ching Chang
(74) *Attorney, Agent, or Firm*—Smith-Hill and Bedell

(57) ABSTRACT

An engine is described having two camshafts 14, 16 each of which carries two groups of cams and comprises an inner shaft coupled for rotation with a first group of cams and an outer tube rotatably supported by the inner shaft and coupled for rotation with the second group of cams. A phaser 12 is provided to enable the phase of at least one of the two groups of cams on one of the SAP camshafts 14, 16 to be varied with reference to the phase of the engine crankshaft. Drive links in the form of meshing gear wheels, drive chains or belts, couple the two corresponding groups of cams on the respective camshafts for rotation in unison with one another.

7 Claims, 3 Drawing Sheets

ENGINE WITH VARIABLE VALVE TIMING

CROSS-REFERENCE TO RELATED APPLICATION

This application claims priority under 35 US 119 of United Kingdom Patent Application No. 0413887.1 filed Jun. 21, 2004.

FIELD OF THE INVENTION

The present invention relates to an engine with a variable valve timing. In particular, the invention relates to implementing variable valve timing in an engine employing SCP camshafts, the term "SCP camshafts" being used herein to refer to a camshafts which carries two groups of cams and comprises an outer tube coupled for rotation with a first group of cams and an inner shaft rotatably supported by the outer tube and coupled for rotation with the second group of cams. The acronym "SCP" stands for "Single Cam Phaser" because such a camshafts has hitherto been used to implement variable valve timing in an engine having a single camshafts by using a phaser to rotate the outer tube relative to the inner shaft.

BACKGROUND OF THE INVENTION

Several internal combustion engines have a layout where multiple camshafts each have intake and exhaust cams along their length. Examples of such a layout can be found in the following engines:

- Push rod V-engines, where two parallel camshafts are situated next to each other in the engine block. Several V-twin motorcycle engines currently use such a layout.
- DOHC (dual overhead cam) engines where the valve layout is rotated by 90° (to improve port generated swirl). Each camshafts then has intake and exhaust cams along its length.
- SOHC. (single overhead cam) V-engines where a single camshafts controls all the valves on each bank.

It is desirable to be able to control the phase of the intake and the exhaust cams in such engines independently and this would be rendered possible by the use of two SCP camshafts. However, the use in such a case of two independent actuators (or phasers) to transmit torque separately from the engine crankshaft to each SCP camshafts would present problems. In particular, such a solution would prove costly to implement, because a separate set of sensors, control valves, oil feeds, and actuator parts would be required for each camshafts. There would also be added complications for the electronic engine control unit.

SUMMARY OF THE INVENTION

With a view to mitigating the foregoing disadvantages, the present invention provides an engine having a crankshaft, a first SCP camshafts, namely a camshafts carrying first and second groups of cams and comprising an outer tube coupled for rotation with the first group of cams and an inner shaft rotatable relative to the outer tube and coupled for rotation with the second group of cams, a phaser for enabling the phase of at least one of the two groups of cams on the first SCP camshafts to be varied with reference to the phase of the engine crankshaft, a second SCP camshafts having a second inner shaft and a second outer tube coupled for rotation two further groups of cams, and drive links for ensuring that each group of cams on the first SCP camshafts rotates in unison with a corresponding one of the two groups of cams on the second SCP camshafts.

The drive links ensuring that the inner shafts and the outer tubes of the two SCP camshafts rotate in unison with one another may comprise continuous belts (which term in the present context includes chains) or gear drives.

The invention allows the phase of the intake and/or exhaust cams of an engine with two SCP camshafts to be varied with reference to the phase of the crankshaft using a single phaser.

To vary the phase of both the intake and the exhaust cams relative to the engine crankshaft, it is possible either to use one twin vane-type phaser, such as described in EP 1 234 954, or to use two single vane-type phasers, one phaser acting to vary the phase of the intake valves relative to the crankshaft and the other acting to vary the phase of the exhaust cams.

The layout of the phaser or phasers is not of fundamental importance to the present invention. Thus, it is possible when using a twin vane-type phaser for it to be mounted directly on one of the SCP camshafts or for it to be mounted on the engine block and indirectly coupled to both SCP camshafts. In a similar vein, if two single phasers are used, each of them can be directly mounted on one of the two SCP camshafts or it may be mounted on the engine block and coupled indirectly to one group of cams of each of the two SCP camshafts.

BRIEF DESCRIPTION OF THE DRAWINGS

The invention will now be described further, by way of example, with reference to the accompanying drawings, in which.

DETAILED DESCRIPTION OF THE PREFERRED EMBODIMENTS

Figure 1:
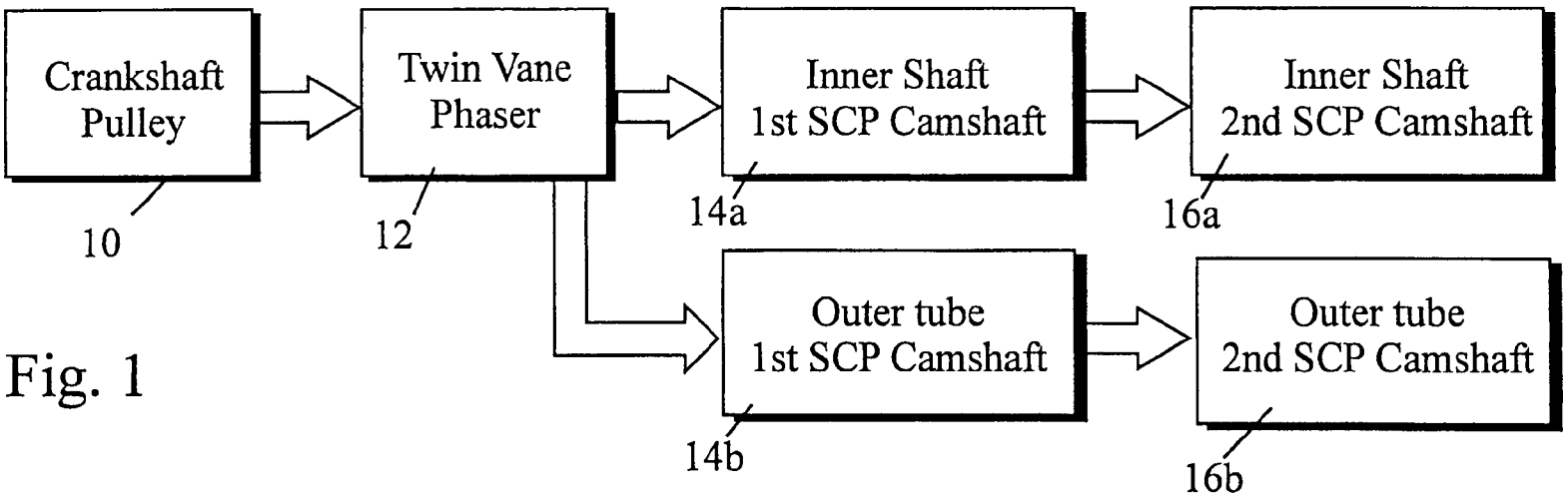
FIG. 1 schematic shows a layout using two SCP camshafts and a single twin vane-type phaser.

The layout in FIG. 1 gives an example of an engine assembly that uses two SCP camshafts. A twin vane-type phaser 12 driven by the engine crankshaft 10 drives the inner shaft 14*a* and the outer tube 14*b* of the first SCP camshafts which are in turn are coupled for rotation with the inner shaft 16*a* and outer tube 16*b* of the second SCP camshafts by drive links represented in the drawings by arrows. As the twin vane-type phaser 12 is itself known, e.g. From EP-A-1 234 954, it is not deemed necessary to describe its construction in detail in the context of the present invention. It suffices to understand that the twin vane-type phaser 12 can alter the phase of both the inner shafts 14*a*, 16*a* and the outer tubes 14*b*, 16*b* of the SCP camshafts relative to the engine crankshaft 10.

Figure 2:
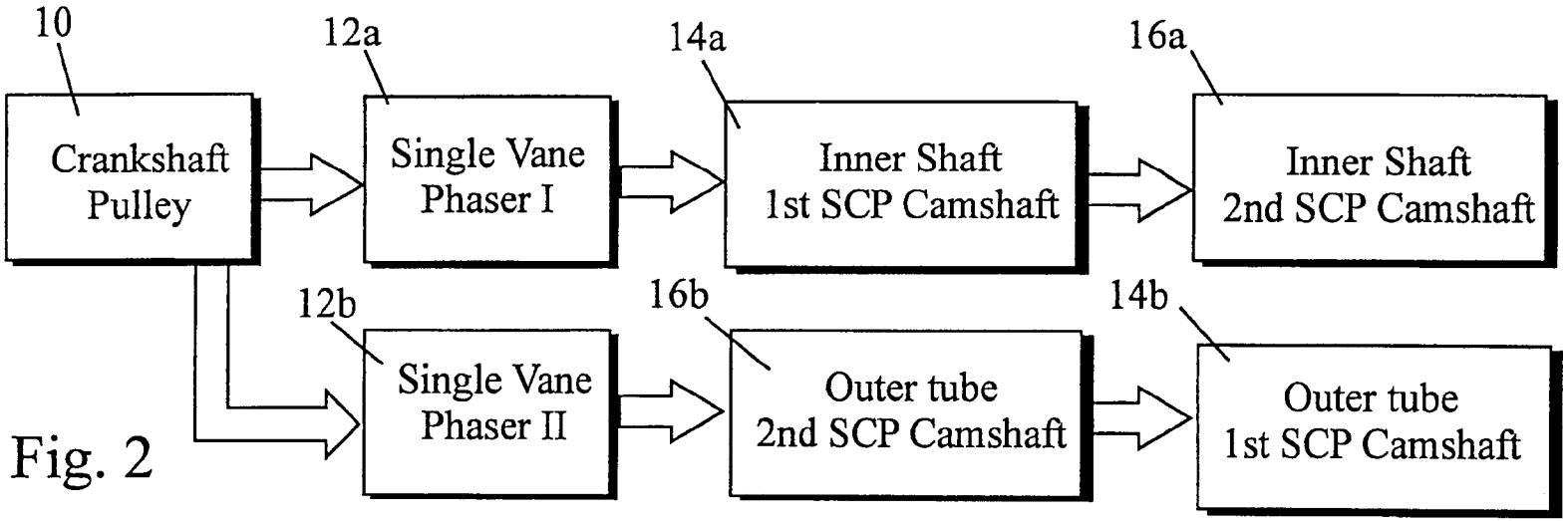
FIG. 2 is a similar view to FIG. 1 showing a layout using two separate single vane-type phasers.

In the layout of FIG. 2, the twin vane-type phaser 12 is replaced by two separate single vane-type phasers 12*a* and 12*b* each of which can only alter the phase of one group of cams relative to the engine crankshaft. In other respects, the two layouts are the same.

FIGS. 1 and 2 suggest that torque is always transmitted from the phaser 12 to the first SCP camshafts 14 and that from there the torque is transmitted to the second camshafts 16. While this may be the case in some embodiments of the invention, it is not necessary the case, as will become clear from other embodiments described below. As long as the inner shafts and the outer tubes of the SCP camshafts are coupled to rotate in unison, it does not matter how torque is transmitted to them by the phaser(s). Thus the phaser may itself separately drive the two SCP camshafts, using common or separate drive links. The drive links may themselves be meshing gear wheels, chains or belts.

Figure 3:
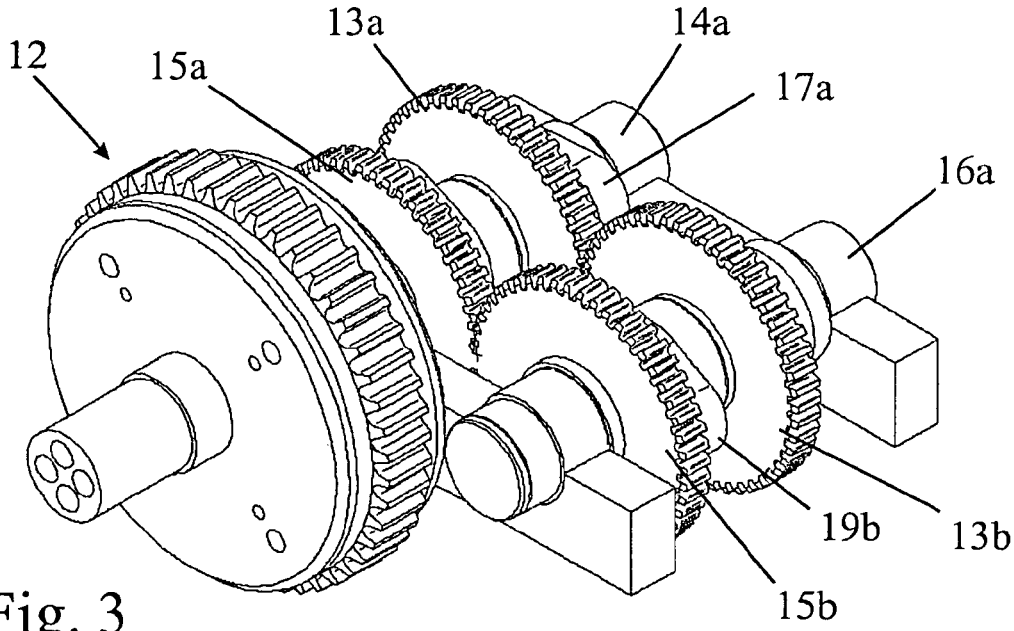
FIG. 3 is a partial perspective view of an embodiment applicable to a DOC or push rod engine in which the drive links are constituted by directly meshing gear wheels.
Figure 4:
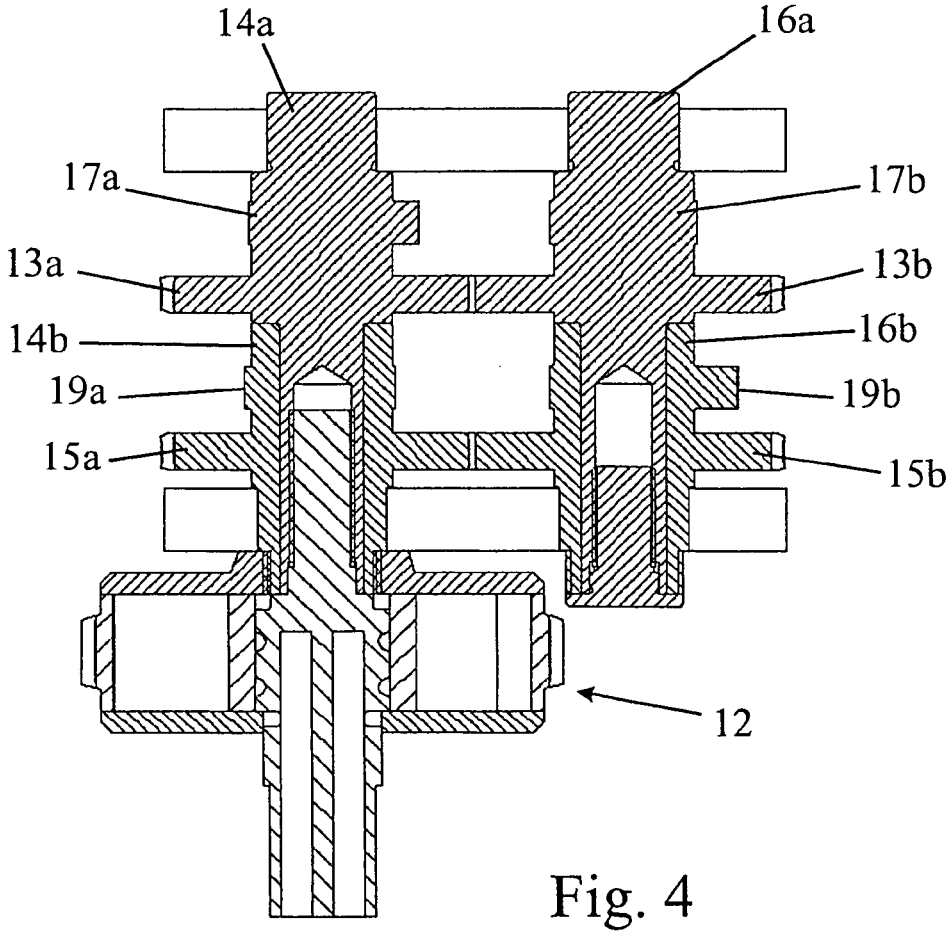
FIG. 4 is a section through the embodiment shown in FIG. 3, FIGS. 5 and 6 are respectively a front and a perspective view of an embodiment applicable to an engine have two banks of cylinders each with a single overhead SCP camshafts (i.e. Ea SOC. V-engine)

The embodiment of the invention shown in FIG. 3 and FIG. 4 has two assembled SCP camshafts each of which, for simplicity, is shown as having only two cams, one driven by the inner shaft and the other by the outer tube. In this case, two of the cams 17*a* and 17*b* can be formed directly on the two inner shafts 14*a* and 16*a* while the other two cams 19*a* and 19*b* can be formed on the two outer tubes 14*b* and 16*b*. It is however possible to provide multiple cams on each SCP camshafts, such that a first group will rotate with the inner shaft and the second with the outer tube. The cams in this case are formed on separate collars that are slid in sequence over the outer tube. Cams that are to rotate with the outer tube have their collars coupled to the outer tube, such as by heat shrinking, while cams that are to rotate with the inner shaft are a loose fit on the outer tube and are connected to the inner shaft by pins that pass through circumferentially elongated slots in the outer tube.

In the embodiment of FIGS. 3 and 4, the drive links coupling the inner shafts of the two SCP camshafts for rotation with one another are two meshing gearwheels 13*a* and 13*b* while two further meshing gear wheels 15*a* and 15*b* couple the two outer tubes for rotation with one another. A twin vane-type phaser 12 is shown as driving the camshafts 14, but it could clearly alternatively drive the second camshafts 16. As a further possibility two single vane-type phasers could be mounted on the two camshafts, one driving the inner shafts and the other the outer tubes.

Whereas the engine of FIGS. 3 and 4 has two camshafts arranged side by side on the same cylinder block, the remaining embodiments of the invention described below relate to an engine with two banks of cylinders, such as a V-engine, with an SCP camshafts associated with each bank of cylinders.

Figure 5:
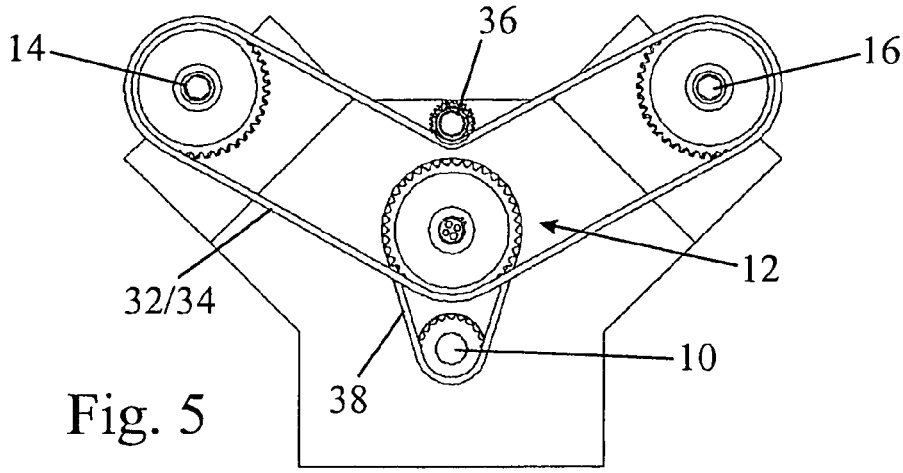
Figure 6:
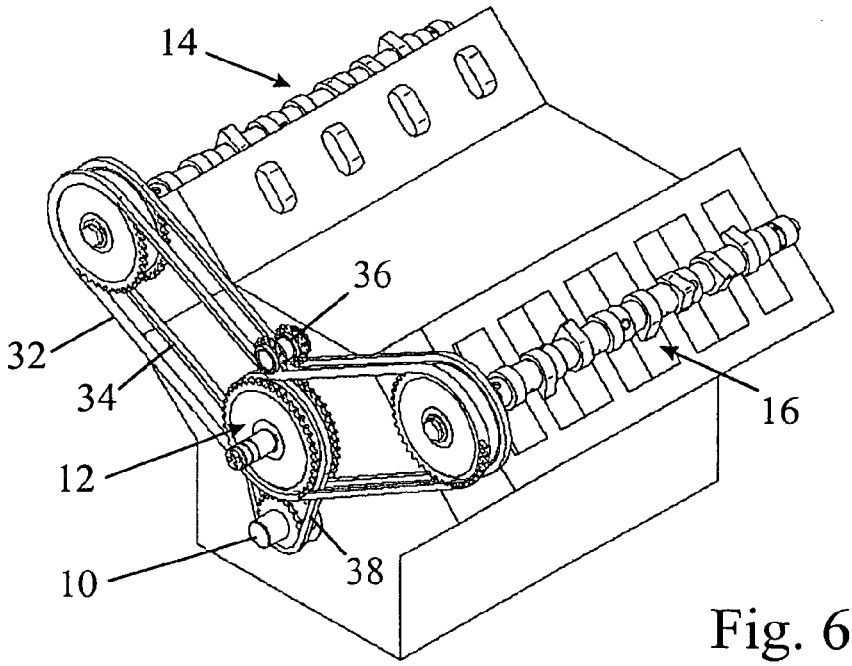

The embodiment of FIGS. 5 and 6 employs a twin vane-type phaser 12 that is not directly mounted on either camshafts but on the engine cylinder block. The twin vane-type phaser 12 has a driven sprocket which engages a chain 38 that passes around the crankshaft sprocket 10. The phaser has two drive sprockets engaged by two chains 32 and 34, which in FIG. 5 lie one behind the other. One chain 32 passes over sprockets on the SCP camshafts 14 and 16 which drive the inner shafts while the other chain 34 passes over sprockets which drive the outer tubes of the two SCP camshafts. The two chains 32 and 34 also pass under free-wheeling idler sprockets 36 which constrain the chains to follow a compact path and can also be used for chain tensioning.

Figure 7:
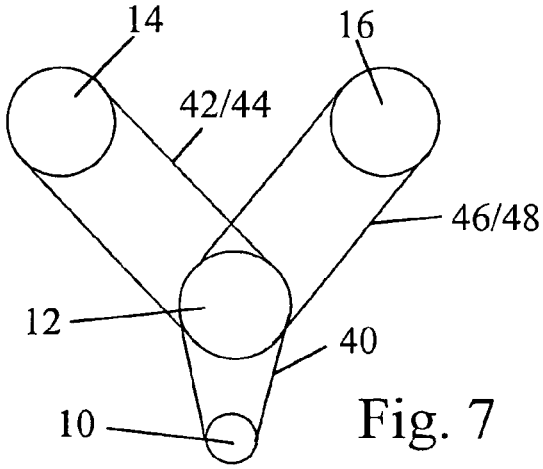
FIGS. 7 and 8 are schematic representations of alternative drive link layouts applicable to SOHC V-engines.

In FIG. 7, a twin vane-type phaser 12 driven by means of a chain 40 that passes around the crankshaft sprocket 10 has two pairs of ganged drive sprockets. One pair drives the inner shafts of the two camshafts 14, 16 through two chains 42, 46 while the other pair drives the outer tubes of the two camshafts through chains 44, 48 lying directly behind the chains 42 and 46 in the drawing.

Figure 8:
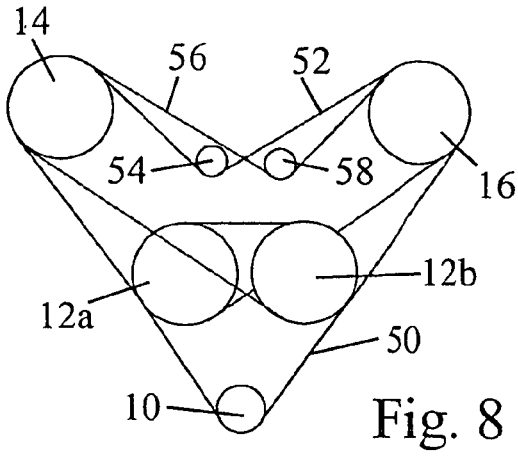

The embodiment of FIG. 8 uses two single vane-type phasers 12*a* and 12*b* that are driven by a common chain 50 that passes around the crankshaft sprocket 10. The phase 12*a* drives the inner shafts of the two camshafts 14, 16 by way of a chain 52 that passes under an idler sprocket 54 while the phaser 12*b* drives the outer tubes of the two camshafts by way of a chain 56 that passes under an idler sprocket 58.

Though, for convenience, reference has been made above to vane-type type phasers, it should be clear that the invention can use any form of phaser change mechanism, of which numerous types are disclosed in the prior art.

While the invention has been described above by reference to preferred embodiments, it will be clear to the person skilled in the art that various modifications may be made without departing from the scope of the invention as set forth in the appended claims.

The invention claimed is:

1. An engine having a crankshaft, a first SCP camshafts, namely a camshafts carrying first and second groups of cams and comprising an outer tube coupled for rotation with the first group of cams and an inner shaft rotatable relative to the outer tube and coupled for rotation with the second group of cams, a phaser for enabling the phase of at least one of the two groups of cams on the first SCP camshafts to be varied with reference to the phase of the engine crankshaft, a second SCP camshafts having a second inner shaft and a second outer tube coupled for rotation two further groups of cams, and drive links for ensuring that each group of cams on the first SCP camshafts rotates in unison with a corresponding one of the two groups of cams on the second SCP camshaft.

2. An engine according to claim 1, wherein the drive links comprise meshing gear wheels coupling the inner shafts of the two SCP camshafts for rotation with one another and coupling the outer tubes of the two SCP camshafts for rotation with one another.

3. An engine according to claim 1, wherein the drive links comprise belts coupling the inner shafts of the two SCP camshafts for rotation with one another and coupling the outer tubes of the two SCP camshafts for rotation with one another.

4. An engine as claimed in claim 1, wherein the phaser is twin phaser arranged to vary the phase of both groups of cams on the first SCP camshafts relative to the engine crankshaft.

5. An engine as claimed in claim 4, wherein the phaser is a hydraulically operated vane-type phaser.

6. An engine as claimed in claim 1, wherein two single phasers are provided, one to vary the phase of a first groups of cams of the two SCP camshafts relative to the engine crankshaft and the other to vary the phase of the second groups of cams of the two SCP camshafts relative to the engine crankshaft.

7. An engine as claimed in claim 6, wherein the phaser is a hydraulically operated vane-type phaser.

* * * * *